US008887775B2

(12) United States Patent
Burkholder

(10) Patent No.: US 8,887,775 B2
(45) **Date of Patent: *Nov. 18, 2014**

(54) SPILL AVOIDANCE SYSTEM AND METHOD

(75) Inventor: Steve Burkholder, Annapolis, MD (US)

(73) Assignee: Ameri-Kart Corp., Bristol, IN (US)

( * ) Notice: Subject to any disclaimer, the term of this patent is extended or adjusted under 35 U.S.C. 154(b) by 925 days.

This patent is subject to a terminal disclaimer.

(21) Appl. No.: 13/022,816

(22) Filed: Feb. 8, 2011

(65) Prior Publication Data

US 2011/0192842 A1 Aug. 11, 2011

Related U.S. Application Data

(63) Continuation of application No. 11/993,074, filed as application No. PCT/US2006/023966 on Jun. 21, 2006, now Pat. No. 7,886,781, application No. 13/022,816, which is a continuation-in-part of application No. 11/302,199, filed on Dec. 14, 2005, now Pat. No. 7,673,659.

(60) Provisional application No. 60/692,261, filed on Jun. 21, 2005.

(51) Int. Cl.
*B65B 1/04* (2006.01)
*B67D 7/36* (2010.01)

(52) U.S. Cl.
CPC ..... *B67D 7/365* (2013.01); *B67D 7/362* (2013.01)
USPC ..... 141/308; 141/95; 141/198; 141/303; 137/433

(58) Field of Classification Search
CPC ..... B67D 7/362; B67D 7/365; B67D 7/367; B60K 15/04
USPC ..... 141/5, 46, 59, 95, 198, 199, 201, 205, 141/302, 216, 303, 308; 220/86.1, 86.2; 137/587, 588, 433
See application file for complete search history.

(56) References Cited

U.S. PATENT DOCUMENTS

| | | | | |
|---|---|---|---|---|
| 3,103,958 | A | 9/1963 | Rath | |
| 4,441,533 | A | 4/1984 | Snyder et al. | |
| 4,526,216 | A | 7/1985 | Lake, Jr. | |
| 4,700,864 | A | 10/1987 | Galles et al. | |
| 4,765,504 | A | 8/1988 | Sherwood et al. | |
| 4,768,566 | A * | 9/1988 | Ito et al. | 220/86.2 |

(Continued)

OTHER PUBLICATIONS

International Search Report; Corresponding Application Serial No. PCT/US06/23966; International Filing Date Jun. 21, 2006; Authorized Officer Maust, Timothy L.; Issued Dec. 15, 2006. (5 pages).

(Continued)

*Primary Examiner* — Timothy L Maust
(74) *Attorney, Agent, or Firm* — Benesch Friedlander Coplan & Aronoff LLP

(57) ABSTRACT

A system, for preventing overflow in a tank, fillable via a nozzle, includes a fill passage connecting the storage tank to an external atmosphere. An adjacent passage has a lower end disposed at a predetermined level within the storage tank and an upper end communicating with a hole in the fill passage. A vent passage connects the adjacent passage to the external atmosphere, and a valve is disposed in the vent passage, permitting the flow of air through the vent passage and prohibiting the flow of liquid through the vent passage.

17 Claims, 6 Drawing Sheets

(56) References Cited

U.S. PATENT DOCUMENTS

| | | | | | |
|---|---|---|---|---|---|
| 4,836,835 | A | | 6/1989 | Harris | |
| 4,877,146 | A | * | 10/1989 | Harris | 220/746 |
| 5,090,459 | A | * | 2/1992 | Aoki et al. | 141/59 |
| 5,244,022 | A | * | 9/1993 | Gimby | 141/301 |
| 5,271,438 | A | | 12/1993 | Griffin et al. | |
| 5,297,595 | A | | 3/1994 | Haile et al. | |
| 5,474,048 | A | * | 12/1995 | Yamazaki et al. | 123/519 |
| 5,570,730 | A | | 11/1996 | Keehn et al. | |
| 5,660,214 | A | * | 8/1997 | Pettesch | 141/198 |
| 5,669,361 | A | * | 9/1997 | Weissinger et al. | 123/520 |
| 5,730,194 | A | | 3/1998 | Foltz | |
| 5,944,069 | A | | 8/1999 | Nusbaumer et al. | |
| 5,975,154 | A | | 11/1999 | Bennett | |
| 5,979,417 | A | * | 11/1999 | Hyodo et al. | 123/516 |
| 6,062,274 | A | * | 5/2000 | Pettesch | 141/1 |
| 6,269,832 | B1 | * | 8/2001 | Besnard et al. | 137/137 |
| 6,536,465 | B2 | * | 3/2003 | David et al. | 137/442 |
| 6,729,367 | B2 | | 5/2004 | Peterson | |
| 6,851,458 | B2 | * | 2/2005 | Nakajima et al. | 141/44 |
| 6,854,492 | B2 | * | 2/2005 | Benjey | 141/198 |
| 6,857,454 | B2 | * | 2/2005 | Yanase et al. | 141/303 |
| 6,886,705 | B2 | * | 5/2005 | Souma et al. | 220/86.2 |
| 6,904,943 | B2 | * | 6/2005 | Dennis | 141/1 |
| 7,040,343 | B2 | * | 5/2006 | Tseng | 137/390 |
| 7,168,466 | B2 | * | 1/2007 | Ganachaud et al. | 141/286 |
| 7,757,729 | B2 | | 7/2010 | Smith et al. | |
| 7,793,682 | B2 | * | 9/2010 | Smit | 137/391 |
| 7,866,356 | B2 | * | 1/2011 | Benjey | 141/198 |
| 7,886,781 | B2 | * | 2/2011 | Burkholder | 141/198 |
| 8,402,994 | B2 | * | 3/2013 | Smit | 137/391 |
| 2001/0054615 | A1 | * | 12/2001 | Krogull et al. | 220/86.2 |
| 2007/0068595 | A1 | * | 3/2007 | Ganachaud | 141/59 |
| 2008/0078467 | A1 | * | 4/2008 | Home | 141/95 |

OTHER PUBLICATIONS

Notice of Allowance and Issue Fee(s) Due; Corresponding U.S. Appl. No. 11/993,074, filed Feb. 14, 2008; Dated Oct. 14, 2010. (7 pages).

Notice of Allowance and Issue Fee(s) Due; Corresponding U.S. Appl. No. 11/302,199, filed Dec. 24, 2005; Dated Oct. 16, 2009. (8 pages).

Office Action; Corresponding U.S. Appl. No. 11/302,199, filed Dec. 24, 2005; Dated Jun. 19, 2009. (6 pages).

Office Action; Corresponding U.S. Appl. No. 11/302,199, filed Dec. 24, 2005; Dated Dec. 22, 2008. (8 pages).

Restriction Requirement; Corresponding U.S. Appl. No. 11/302,199, filed Dec. 24, 2005; Dated Sep. 30, 2008. (5 pages).

* cited by examiner

SPILL AVOIDANCE SYSTEM AND METHOD

This application is a continuation of U.S. patent application Ser. No. 11/993,074 filed in the United States Patent and Trademark Office on Feb. 14, 2008, which issued on Feb. 15, 2011 as U.S. Pat. No. 7,886,781, which is the U.S. National Stage of PCT/US2006/023966 filed Jun. 6, 2006, which claims the benefit of priority from U.S. Provisional Application No. 60/692,261, filed in the United States Patent and Trademark Office on Jun. 21, 2005, and is a Continuation-in-part of U.S. patent application Ser. No. 11/302,199, filed in the United States Patent and Trademark Office on Dec. 14, 2005, which issued as U.S. Pat. No. 7,673,659. The entirety of these Applications are incorporated herein by reference.

BACKGROUND OF THE INVENTION

1. Field of the Invention

Apparatuses and methods consistent with the present invention are generally related to storage tanks and are specifically related to storage tank filling systems which prevent overflow during and subsequent to filling and to storage tank venting systems for venting a storage tank to the atmosphere efficiently and environmentally.

2. Description of the Related Art

It is well known to use storage tanks for holding a variety of fluids such as oil, gasoline, and diesel fuel to name a few. Proper filling of storage tanks is a universal concern, as overfilling of storage tanks may result in spillage, damage to the tank or filling equipment, contamination of land or ground water, or other serious and potentially dangerous results. Concerns over spillage of the tank contents are particularly acute when the tank contents are flammable, toxic and/or environmentally hazardous.

Spillage from fuel tanks on pleasure boats and other marine vessels is particularly troublesome. Some contemporary estimates of such fuel spillage are in excess of six million gallons annually in the United States alone. Globally, fuel spillage is many times this amount. The resultant fuel losses are economically and ecologically detrimental in terms of wasted fuel resources and environmental contamination.

An internal fuel tank on a marine vessel is typically provided with a vent to enable vapor and fumes to escape under pressure while fuel is being pumped into the fuel tank via the fuel fill tube. As the engine consumes fuel, air is drawn into the tank via the air vent to fill the space from the consumed fuel. Venting is also necessary to accommodate expansion of the fuel when it is heated. Conventionally, during filling of the fuel tank, some fuel may be discharged through the vent into the water as the attendant attempts to fill the tank to capacity. In fact, it is not unknown for filling attendants to purposely fill the tank until fuel is discharged from the vent, using this as an indication that the tank is completely full. It is also possible that fuel may be discharged through the vent subsequent to filling. For example, fuel can be discharged through the vent in a tank filled to capacity as a result of the boat listing from side to side due to waves, wind or other causes. Also conventionally, fuel may be discharged through the vent in a tank filled to capacity if a subsequent rise in ambient temperature causes the fuel to expand.

The use of fuel dispensing nozzles that automatically shut off the flow of fuel to the tank when the tank is full have been used to avoid fuel spillage during filling. These nozzles typically operate by sensing a pressure: change at an end of the nozzle that results from fuel backing up within the tank fill tube. Use of a fuel dispensing nozzle with automatic shut-off will prevent fuel discharge through the fill tube during filling if the fill tube is properly designed to trigger the shut-off at the appropriate time. However, with many designs the automatic shut-off may be triggered only to have fuel surge out of the vent or out of the tank fill tube because of pressure trapped in the tank. Because of the location of the vent in many applications, it is also possible that fuel will be discharged through the vent during filling. Discharge through the vent may also occur after filling, even if the automatic shut-off is triggered. For example, if the tank is filled to near capacity, fuel can be discharged through the vent due to boat listing or fuel expansion.

A conventional nozzle 10 is illustrated in FIG. 1. Fuel is pressurized in the nozzle passage 1 by a pump (not shown). The flow of fuel is blocked in the nozzle 10 by a valve 3 that is held in a closed position by a spring 2. The valve 3 is connected to a hand-operated trigger 4 at a pivot point 5. The trigger 4 is also connected to a piston 6 at a second pivot point 7. The piston 6 is locked in a dispensing position by a pin 8 that forces balls 9 into a groove in the nozzle housing 11. The pin 8 is connected to a diaphragm 12 that is held in position by a second spring 13. When fuel is dispensed, the trigger 4 is lifted, lifting the pivot point 5 and the valve 3, allowing fuel to flow. The fuel travels to a venturi 15 where a spring loaded ban and seat create a vacuum in the passage 16 that is in communication with the diaphragm 12. The passage 16 is also open to atmospheric pressure through a hole 17 near the end of the dispensing nozzle. When fuel is being dispensed, the pressure in the passage 16 is lowered by the venturi 15, but is replaced by atmospheric pressure through the hole 17 in the nozzle. During conventional automatic shut-off, when the hole 17 is covered by fuel surging up from the tank's fill tube, the pressure drops in the passage 16, drawing the diaphragm 12 against the second spring 13, and the pin 8 is lifted from its locking position. Thus, the piston 6 moves to release the pivot point 7 in the trigger. When the pivot point 7 is moved, the trigger 4 is ineffective and the spring 2 pushes the valve 3 into the closed position, stopping the flow of fuel.

Some prior approaches to preventing spillage rely on the use of a reservoir designed to capture overflow. However, these approaches require additional parts and the use of a reservoir takes up more space on the vessel. None of these approaches addresses the above-mentioned drawbacks of relying on the automatic shut-off feature of existing fuel dispensing nozzles.

Accordingly, there is a need for a system and method that prevents spillage both during and after filling of a storage tank. It would be desirable to have such a system and method of overflow prevention that facilitates use of automatic shut-off nozzles and does not require provision of an overflow reservoir.

SUMMARY OF THE INVENTION

According to a first exemplary embodiment of the present invention, a system for preventing overflow in a storage tank which is fillable via a nozzle inserted in a fill passage, includes a fill passage, a fill fitting, a lower passage, an upper passage, and a valve. The fill passage connects the storage tank to the external atmosphere. The fill fitting includes a mounting flange, which rests outside an external end of the fill passage, and a sleeve, which fits within the fill passage. The lower passage extends from an upper end, positioned to receive at least a portion of fuel flow from the nozzle, to a lower end in communication with the storage tank. The upper passage extends from an upper end, in communication with a hole in the nozzle, to a lower end in communication with an interior of the lower passage. The valve is connected to the lower passage and has a fill position and a stop fill position. When a level of fuel in the storage tank is below a predetermined level, the valve is in the fill position and permits fuel to flow from the upper end of the lower passage out the lower end of the lower passage. When the level of fuel in the storage tank is at or above the predetermined level, the valve is in the stop fill position and at least partially blocks the flow of fuel out the lower end of the lower passage.

According to a second exemplary embodiment of the present invention, a system for preventing overflow in a storage tank which is fillable via a nozzle inserted in a fill passage, includes a fill passage, a fill fitting, an adjacent passage, a vent passage and a valve. The fill passage connects the storage tank to the external atmosphere. The fill fitting includes a mounting flange, which rests outside an external end of the fill passage, and a sleeve, which fits within the fill passage. The adjacent passage extends from a lower end, which is positioned at a predetermined level within the storage tank, to an upper end in communication with a pressure hole in a nozzle, when inserted into the fill passage. The vent passage extends from the adjacent passage to an external vent, and the valve permits air to pass through the vent passage while prohibiting the passage of fuel through the vent passage. When the level of fuel in the storage tank is below the predetermined level and the tank is being filled, air from the tank 200 which is displaced by fuel escapes from the storage tank through the adjacent passage and the vent passage. When the level of fuel in the storage tank reaches the predetermined level, the lower end of the pressure transfer passage is blocked causing fuel to rise up in the adjacent passage and flow around the hole in the nozzle.

BRIEF DESCRIPTION OF THE DRAWINGS

The above and other exemplary aspects of the present invention will become better understood with reference to the following description and accompanying drawings, which should not be read to limit the invention in any way, in which.

DETAILED DESCRIPTION OF EXEMPLARY EMBODIMENTS OF THE INVENTION

According to exemplary embodiments of the present invention, a fuel spill avoidance system activates the auto shut off mechanism of a standard fill nozzle when fuel in a fuel tank reaches a predetermined level determined to be adequate to prevent spilling. The predetermined level is selected to be reached before the level at which the fill nozzle would shut off in the absence of the system of the present invention. By shutting off fuel flow when the level of fuel in the tank is at a lower level, spillage can be minimized or completely avoided.

It should be understood that the present invention is not limited to fuel tanks, but may include any other type of tank to be filled, as would be understood by one of skill in the art.

Figure 2:
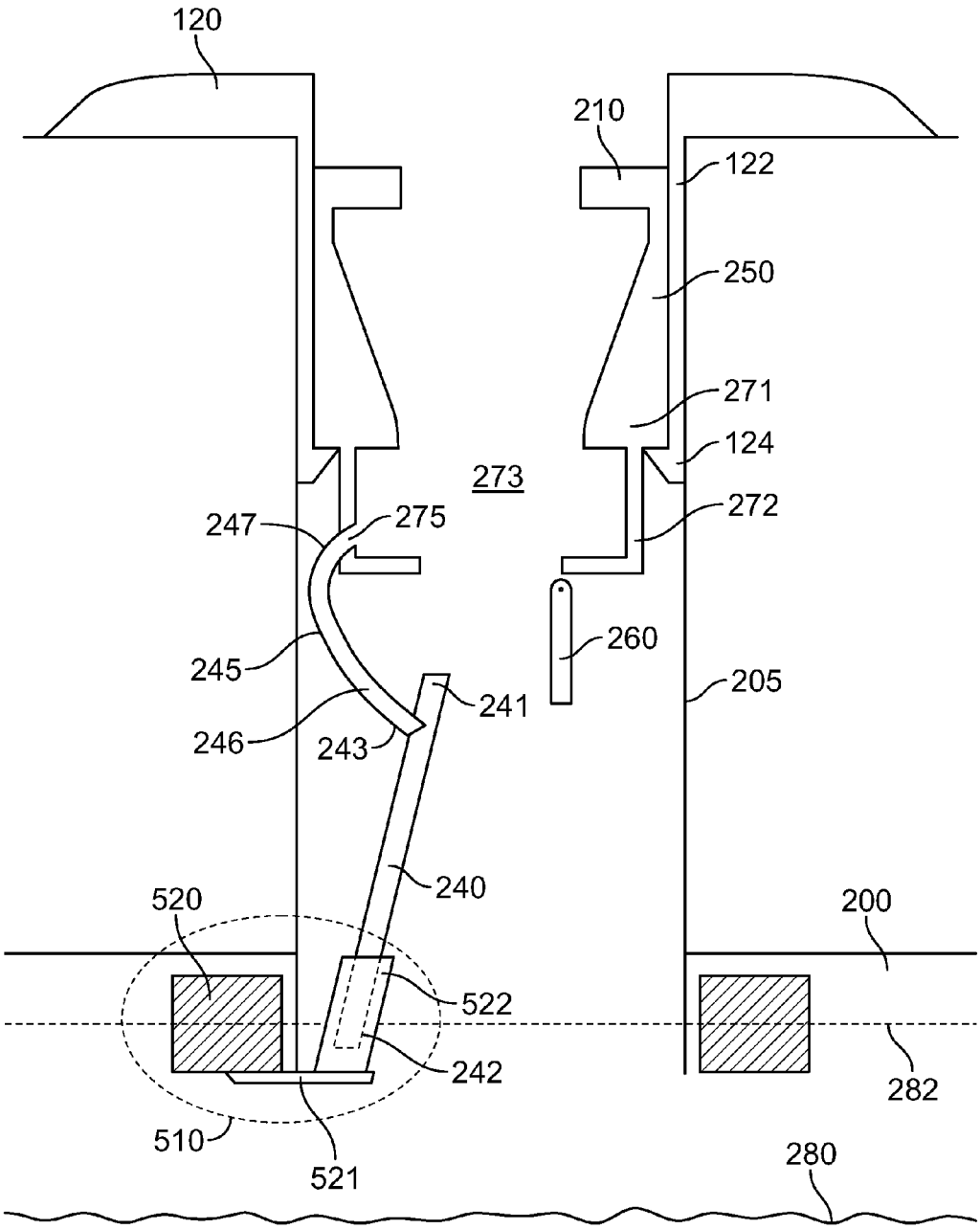
FIG. 2 illustrates a fuel spill avoidance system according to a first exemplary embodiment of the present invention.

FIG. 2 illustrates a liquid spill avoidance system according to the first exemplary embodiment of the present invention.

As illustrated, a fuel tank 200 connects to a fill passage 205 through which the fuel tank 200 may be filled. The term "fill passage" refers to a passage from a storage tank to the exterior of a vehicle for the purposes of filling the storage tank. It may be referred to as a fill hose. The fill passage 205 may be flexible. It should be understood that the present invention is not limited to fuel tanks, but may include another type of tank to be filled, as would be understood by one of skill in the art.

Figure 1:
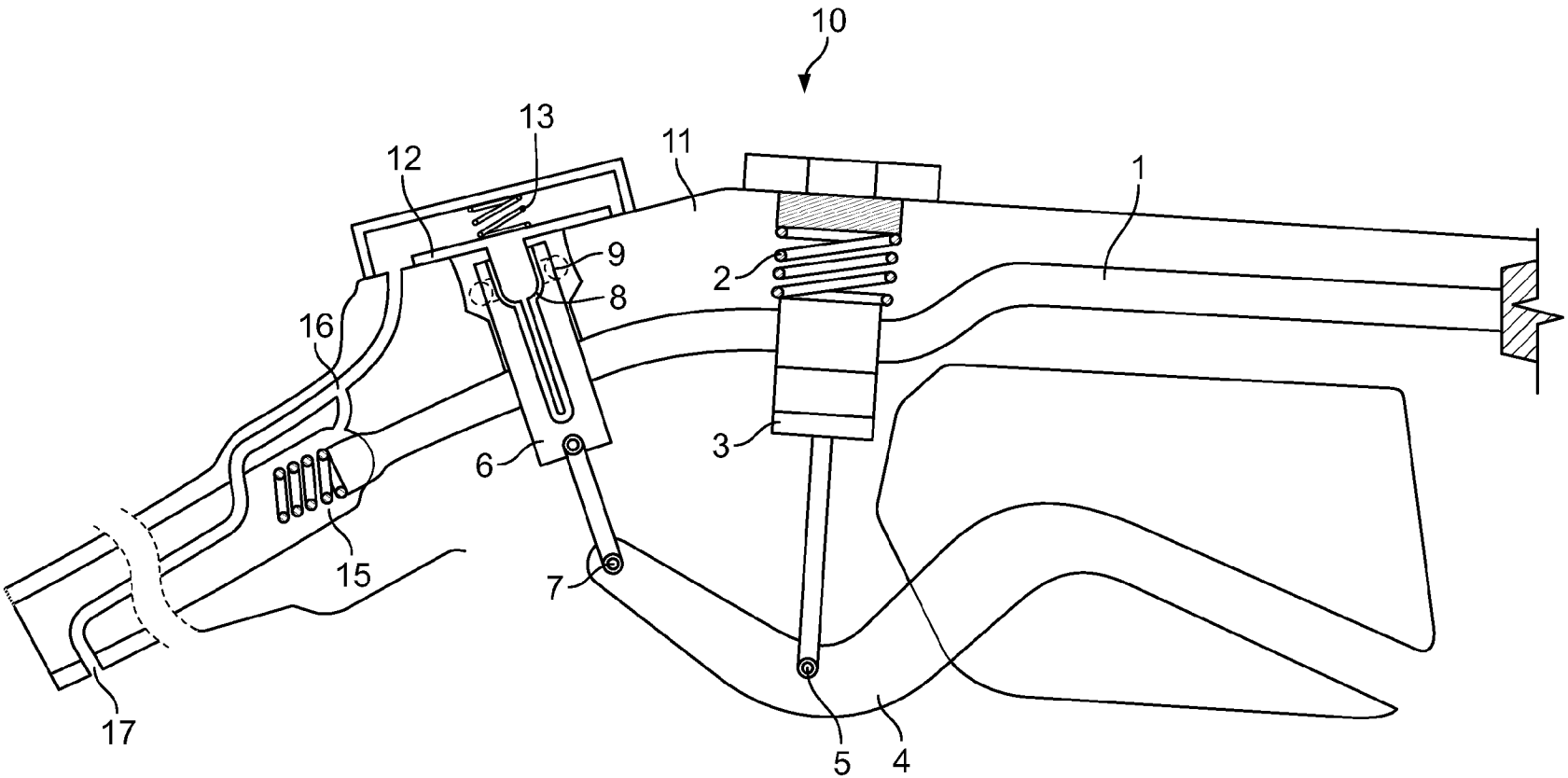
FIG. 1 illustrates a conventional nozzle.
Figure 3:
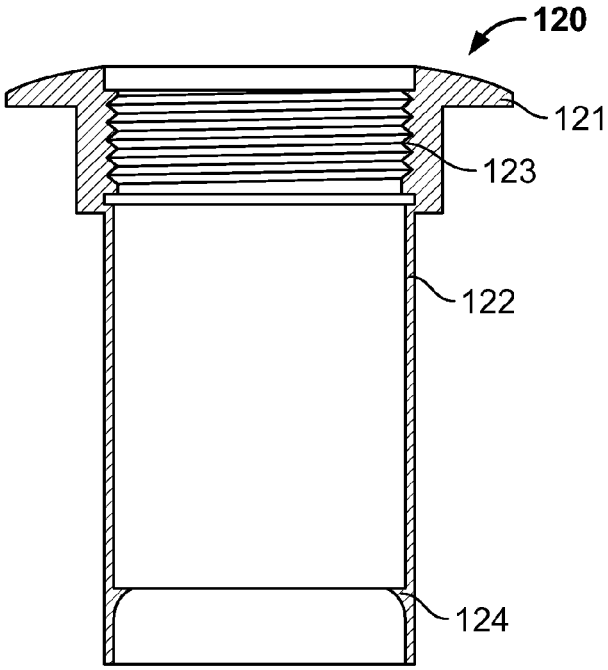
FIG. 3 illustrates a fill fitting according to an exemplary aspect of the present invention.
Figure 4A:
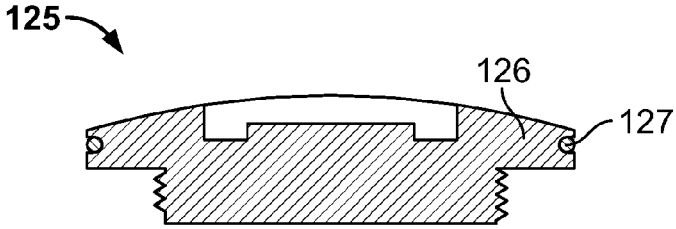
FIGS. 4A and 4B illustrate a sealing cap according to an exemplary aspect of the present invention.
Figure 4B:
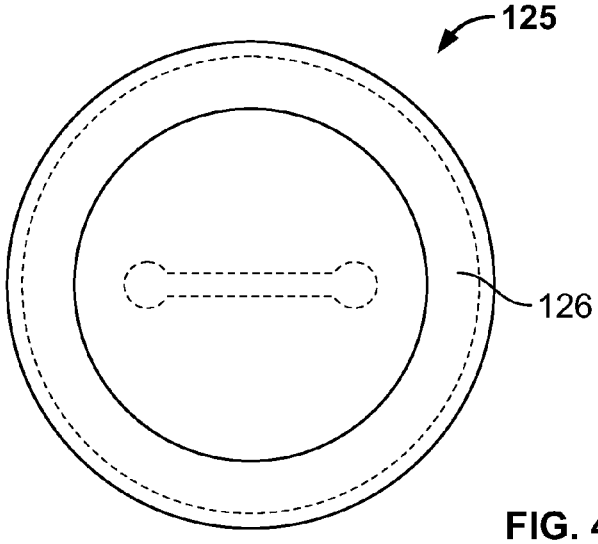

A fill fitting 120 is mounted in an outer end of the fill passage to receive a fill nozzle, for example, nozzle 10 as illustrated in FIG. 1. An exemplary fill fitting is also illustrated in FIG. 3. The fill fitting 120 includes a flange portion 121 and a sleeve extension 122. The flange portion 121 may include a mounting flange that sits around the outer end of the fill passage, and an inner threaded portion 123, which can receive a sealing cap 125, as illustrated in FIGS. 4A and 4B. the sealing cap may include a threaded cap 126 and a sealing o-ring 127, which, in conjunction with the fill fitting, seals the exterior end of the fill passage 205. Alternately, any other method, as would be understood by one of skill in the art may be used to seal the upper end of the fill passage.

The sleeve extension 122 of the fill fitting 120 fits inside the fill passage 205. The fill fitting may also include a stop 124, as described further below.

As shown in FIG. 2, the exemplary system includes a guide ring 210 disposed within the sleeve extension 122 of the fill fitting 120. The guide ring 210 loosely centers the fill nozzle 10 within the fill passage 205. A tapered extension 271 is disposed below the guide ring 210 and is attached to a cup 272 below. When the nozzle 10 is inserted into the fill passage 205, it is centered by the guide ring 210 and the tapered extension 271 and extends to an opening 273 in the bottom of the cup 272. When inserted, the nozzle 10 is positioned so that the pressure sensing hole 17 is disposed between the tapered extension and the lower edge 274 of the cup 272. The lower edge 274 of the cup 272 may form a seal around an inserted nozzle 10 below the hole 17 in the nozzle. Alternately, the lower edge 274 need not form a seal, but merely prevents free flow of fuel out of the cup 272.

The guide ring 210, the tapered extension 271 and the cup 272 may be integrally formed as a single unit 250, as shown in FIG. 2, which is inserted into the sleeve extension 122. The unit 250 may be formed of aluminum, steel, stainless steel, brass, bronze, copper, plastic, epoxy, Marelon®, composite materials, ferrous or non-ferrous metals, or any combination thereof, or any other appropriate material, as would be understood by one of skill in the art. Alternately, the unit 250 may be formed as a single integral piece with the fill fitting 120.

A hinged or spring-loaded flap 260 may be fixed to the lower edge 274 of the cup 272. The insertion of the nozzle 10 opens the flap 260, allowing fuel or other liquid to flow from the nozzle 10 into the storage tank 200.

As would be understood by one of skill in the art, the guide ring 210 maintains the inserted nozzle 10 in a properly-centered position. Alternately, the guide ring 210 may maintain an inserted nozzle in a position which is off-center form the central axis of the fill tube, as needed, as would be understood by one of skill in the art. Further, the guide ring 210 may be omitted entirely and the tapered extension 271 and the cup 272 may function as a positioning element.

As shown in FIG. 2, a lower passage 240 extends from an upper end 241, positioned beneath the cup 272, to a lower end 242 within the fuel tank 200. The upper end 241 of the lower passage 240 is open and positioned to receive a portion of fuel flow from the nozzle 10 when inserted during a filling operation. The above-discussed alignment function of the guide ring 210, the tapered extension 271, and the cup 272 functions to provide a consistent location of the end of the fill nozzle 10, so that at least a portion of fuel flow from the nozzle is directed into the open upper end 241 of the lower passage 240. One of skill in the art will appreciate, however, that the described features for aligning the fill nozzle 10 may not be necessary in all embodiments of the present invention. For example, if the diameter of the fill passage 205 is not much larger than the diameter of the fill nozzle 10, then sufficient fuel flow into the upper end 241 of the lower passage 240 may occur without a need for further alignment.

The lower passage 240 is connected to a valve apparatus 510 at its lower end 242, and to an upper passage 245 near its upper end 241. As illustrated in FIG. 2, the upper passage 245 is a tube, but the upper passage may be any type of passage which creates a fuel communication between a hole 243 in the lower passage to a hole 275 in the cup 272, as would be understood by one of skill in the art, During a filling operation, fuel from the fill nozzle 10 flows in the upper end 241 of the lower passage 240, passes through the length of the passage and out the lower end 242. A low pressure in the upper passage 245 may be created by the extension of the upper passage 245 into the fuel flow in the lower passage 240, or by a venturi (not shown) in the lower passage 240. The low pressure prevents fuel from entering the cup 272 through the upper passage 245 until such time that the fuel level in the tank 200 reaches the predetermined level 282.

The lower passage and the upper passage of the first embodiment, as well as the other passages described herein with respect to the present invention may be formed from nylon or other plastics, copper, brass, steel, stainless steel, aluminum, or flexible hose, or any other appropriate material as would be understood by one of skill in the art. For systems for use on boats, materials which meet the American Boat and Yacht Council Standards, or are approved by the US Coast Guard for use in marine vessel fuel storage systems may be used.

Figure 5A:
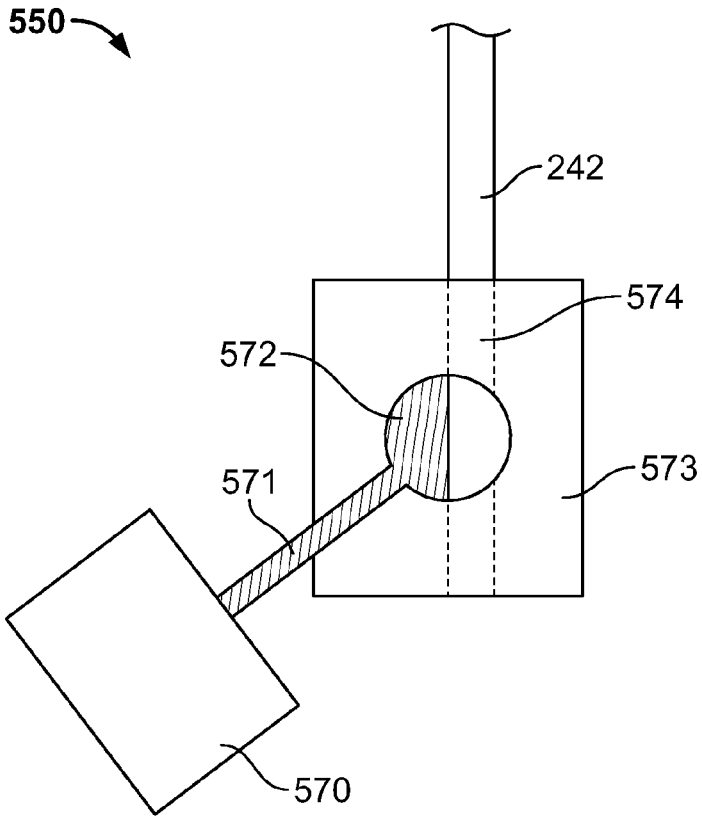
FIGS. 5A and 5B illustrate an alternative valve according to an exemplary aspect of the present invention.
Figure 5B:
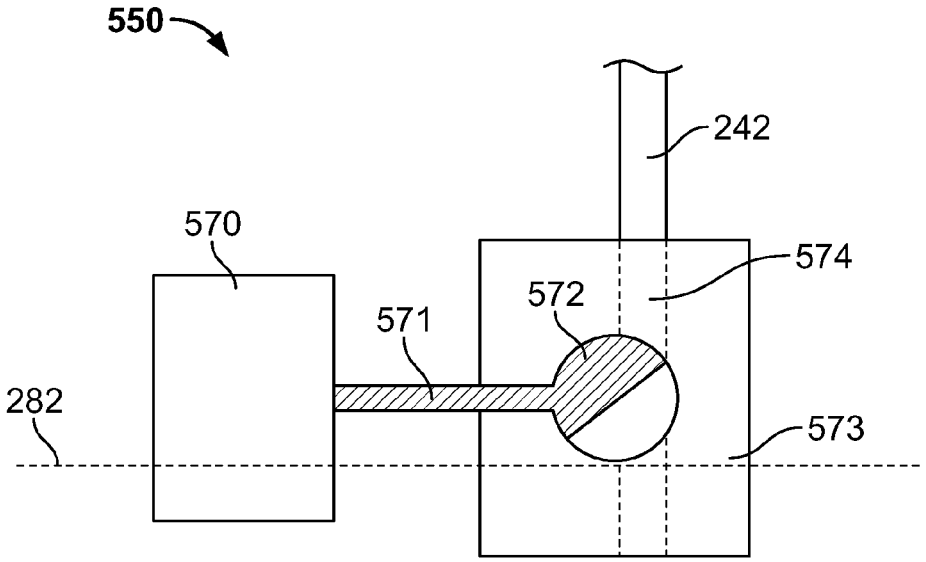

When the fuel level 280 in the tank 200 reaches a predetermined level 282, the valve apparatus 510 functions to block at least a portion of the lower end of the lower passage 240. Operation of the valve will be discussed in further detail below. An alternate valve apparatus 550 is illustrated in FIGS. 5A and 5B.

The reduced or stopped flow of fuel out of the lower passage 240 causes the fuel to back up and travel upward to the upper end 241 of the lower passage. A lower end 246 of the upper passage is inserted into the upper end 241 of the lower passage through the hole 243. The lower end 246 of the upper passage 245 is positioned within the lower passage 240 such that it permits the downward flow of fuel through the lower passage 240 and diverts the upward flow of fuel through the lower passage 240 into the upper passage 245. The upper end 247 of the upper passage 245 is in fuel communication with the interior of the cup 272 via the hole 275 in the cup 272. As described above, the interior of the cup 272 is in communication with the pressure sensing hole 17 when the nozzle 10 is inserted into the fill passage 205.

Thus, when the fuel level in the tank 200 reaches the predetermined level 282, the valve apparatus 510 blocks off the lower end 242 of the lower passage 240, causing the fuel to back up in the lower passage. The fuel rising in the lower passage 240 is diverted into the upper passage 245, through the hole 275, and into the cup 272 surrounding the pressure sensing hole 17. The auto shut off feature of the nozzle 10 is thereby triggered, shutting off the flow of fuel.

According to an exemplary aspect of the present invention, the predetermined fuel level may be selected to also prevent spillage that might later result form the expansion of fuel within the storage tank 200 as a result of heating after the filling operation.

The valve apparatus 510 illustrated in FIG. 2 includes a float 520, a rod 521, and a valve body 522. The float is mounted surrounding a spigot (not shown) that extends into the tank. The rod 521 is mounted horizontally on a lower side of the float 520. The valve body 522 is fixed to the spigot and receives the lower end 242 of the lower passage into an upper end of the valve body 522. A vertical hole in the valve body 522 allows fuel to flow through the body. There is horizontal slot in a lower end of the valve body 522 at which the rod 521 rests. While in a fill position, the rod 521 rests on the a lower side of the slot and allows fuel to pass out of the valve body 522. When the fuel in the tank 200 reaches the predetermined level 282, the float rises 520 lifting the rod 521 to the top of the slit in the valve body 522, closing the vertical hole in the valve body 522, and stopping the flow of fuel through the lower passage.

FIGS. 5A and 5B illustrate an alternative exemplary valve apparatus according to the present invention. FIG. 5A illustrates the valve apparatus 550 during a filling operation, and FIG. 5B illustrates the valve apparatus 550 in a shut-off operation. The valve apparatus includes a valve block 573, having a passage 574 therethrough. The lower end 242 of the lower passage extends to the passage 574. A rotating valve 572 in the valve block 573 attaches to a float 570 via an arm 571. The float 570 floats on top of the fuel in the tank 200. When the fuel level is below the predetermined level 282, the rotating valve permits the flow of fuel out the lower end 242 of the lower passage 240. When, as illustrated in FIG. 5B, the fuel level reaches the predetermined level 282, the float 570 rises and lifts the arm 571, causing the rotating valve 572 to rotate and block off the lower end 242 of the lower passage 240.

In both the valve apparatus 510 of FIG. 2 and the valve apparatus 550 of FIGS. 5A and 5B, the float may be positioned within the tank such that the flow of fuel into the tank does not directly contact the float, thereby providing for accurate monitoring of the fuel level within the tank.

Figure 6:
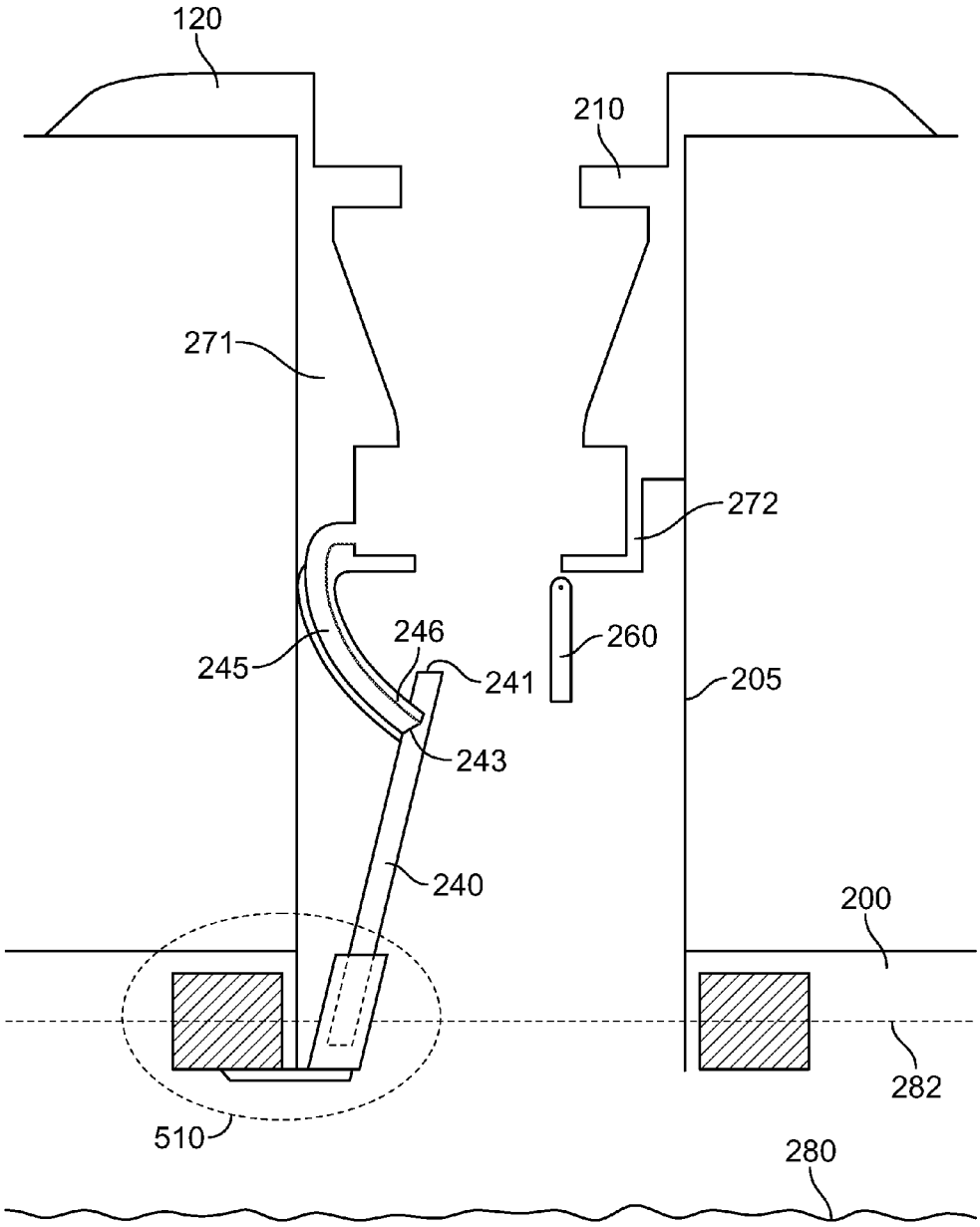
FIG. 6 illustrates a fuel spill avoidance system according to an alternate exemplary aspect of the first embodiment of the present invention.

FIG. 6 illustrates a liquid spill avoidance system according to an alternate exemplary aspect of the present invention.

The system illustrated in FIG. 6 includes a fill fitting 120, a guide ring 210, a tapered extension 271, a cup 272, a lower passage 240, and a valve apparatus 510, as illustrated in FIG. 2. However, according to this exemplary aspect, the fill fitting 120, the guide ring 210, the tapered extension 271, the cup 272, and the upper passage 245 are formed as a single unit.

As illustrated in FIG. 6, the upper passage 245 is integrally formed with the cup 272. As in FIG. 2, a lower end 246 of the upper passage 245 extends into the lower passage 240. However, according to this exemplary embodiment, the upper portion of the upper passage 245 forms a portion of the side of the cup 272, so that the interior of the upper passage 245 is in communication with the interior of the cup 272.

Figure 7:
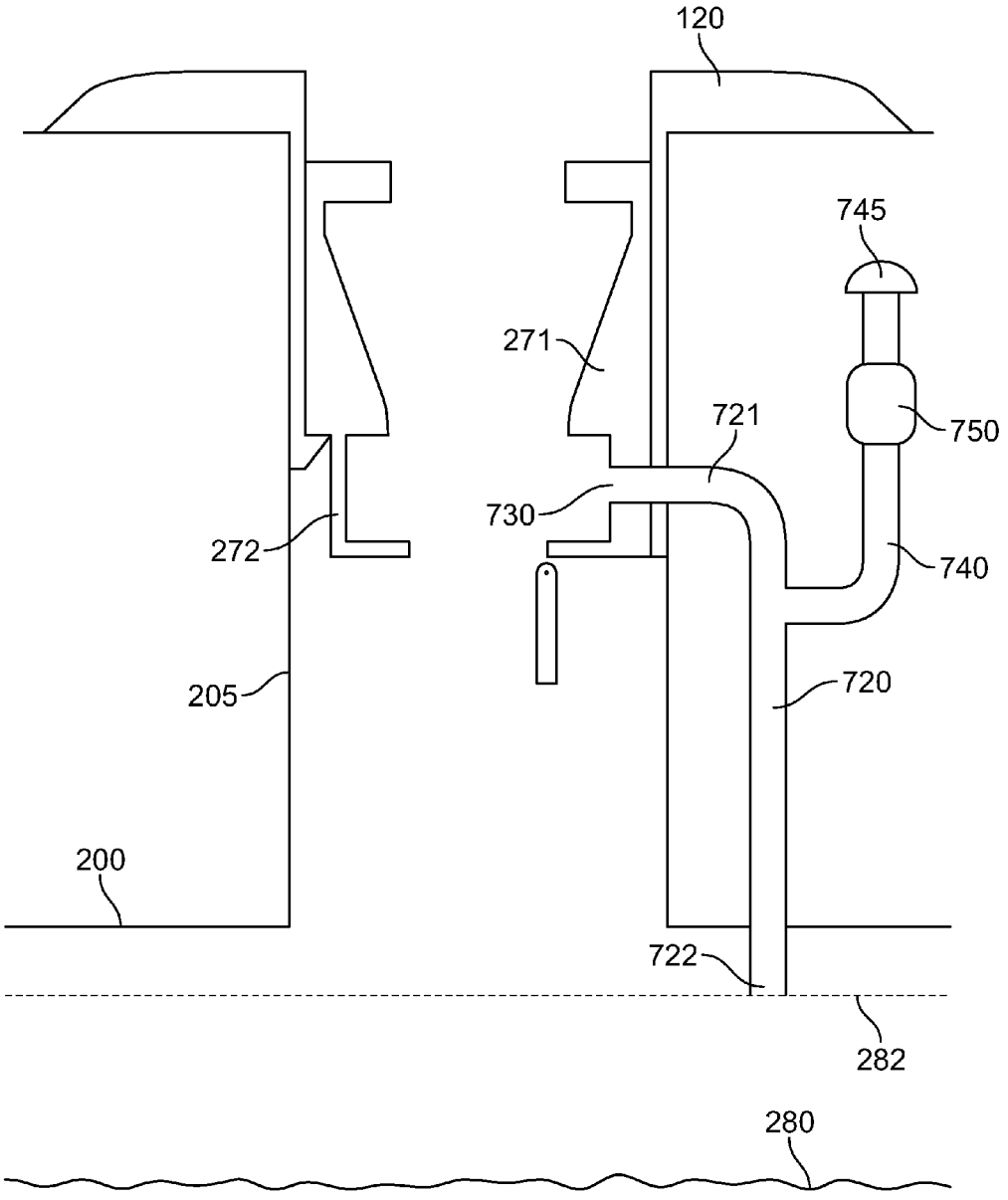
FIG. 7 illustrates a fuel spill avoidance system according to a third exemplary embodiment of the present invention.

FIG. 7 illustrates another exemplary embodiment of a liquid spill avoidance system according to the second exemplary embodiment of the present invention. The tank 200, fill passage 205, fill fitting 120, guide ring 210, tapered extension 271, and cup 272 are similar to those described above with reference to FIGS. 2, 3, and 6, and will not be described again in detail here.

According to this second exemplary embodiment, an adjacent passage 720 extends from a lower end 722 within the tank 200 to an upper end 721 at the cup 272. The lower end 722 is disposed within the tank at the predetermined level 282. The upper end 721 is in fluid communication with the interior of the cup 272 through a hole 730 in the cup and in the side of the fill passage 205.

The second exemplary embodiment illustrated in FIG. 7 also includes a vent passage 740, extending from the adjacent passage 720 to an atmospheric vent 745. A valve 750 on the vent passage 740 permits the passage of air and prevents the passage of liquid. Therefore, the vent passage allows air from the tank 200 to pass out of the atmospheric vent, as the tank is filled and the air is replaced with fuel. Air can also escape through the atmospheric vent 740 when heat causes the expansion of fuel with in the tank. Additionally, as the fuel in the tank is used up, the vent passage 740 allows air from the atmosphere to pass into the tank 200.

When the fuel level in the tank is below the predetermined level, the air in the tank 200 that is displaced by fuel passes out to the atmosphere through the adjacent passage 720, the vent passage 740, and the atmospheric vent 740. When the fuel level in the tank 200 reaches the predetermined level 282, the lower end 722 of the adjacent passage 720 is blocked off, so that air can no longer escape through to the atmosphere. Therefore, the pressure in the tank 200 from the continued flow of fuel forces fuel up through the adjacent passage 720. The fuel cannot pass through the valve 750. Therefore, the fuel forced up through the adjacent passage 720 flows into the cup 272 around the hole 17 in the nozzle 10, thereby causing the diaphragm 12, in the nozzle 10, to rise against the spring 13, and stop fuel flow through the nozzle 10, as described with respect to FIG. 1.

Although the above exemplary embodiments and aspects of the present invention have been described, it will be understood by those skilled in the art that the present invention should not be limited to the described exemplary embodiments, but that various changes and modifications can be made within the spirit and scope of the present invention without departing from the spirit and scope of the present invention as defined by the following claims.

What is claimed is:

1. A system for preventing overflow in a storage tank which is fillable via a nozzle, the system comprising:

a guide configured to fit within a fill passage of the storage tank and receive the nozzle;

a lower passage configured to fit at least partially within the fill passage of a storage tank and receive at least a portion of a flow of liquid from the nozzle;

an upper passage connected to an upper portion of the lower passage; and a valve connected to a lower portion of the lower passage, the valve having a first position and a second position, wherein when a level of liquid in the storage tank is below a predetermined level, the valve is in the first position and liquid is permitted to flow out of the lower portion of the lower passage; and wherein when the level of liquid in the storage tank is at or above the predetermined level, the valve is in the second position and at least partially blocks the flow of liquid out of the lower end of the lower passage.

2. The system of claim 1, wherein the guide includes a cup.

3. The system of claim 1, wherein the upper passage is connected to the guide.

4. A system for preventing overflow in a storage tank which is fillable via a nozzle having a hole, the system comprising:

a lower passage configured to fit at least partially within a fill passage of a storage tank and receive at least a portion of a flow of liquid from the nozzle;

an upper passage connected to an upper portion of the lower passage; and a valve connected to a lower portion of the lower passage, the valve having a first position and a second position, wherein when a level of liquid in the storage tank is below a pre-determined level, the valve is in first position and liquid is prevented from entering the upper passage due to low pressure created by the extension of the upper passage into the fuel flow in the lower passage.

5. The system of claim 4, wherein the upper passage has an upper end in communication with a hole in the nozzle.

6. A system for preventing overflow in a storage tank which is fillable via a nozzle having a hole, the system comprising:

a lower passage configured to fit at least partially within a fill passage of a storage tank and receive at least a portion of a flow of liquid from the nozzle;

an upper passage connected to an upper portion of the lower passage; and a valve connected to a lower portion of the lower passage, the valve having a first position and a second position, wherein at least a portion of the liquid flows out the upper end of the upper passage when the valve is in the second position.

7. A system for preventing overflow in a storage tank which is fillable via a nozzle having a hole, the system comprising:

a cup configured to be disposed within a fill passage of the storage tank, the cup having a hole corresponding to the hole in the nozzle;

a first passage having an upper end communicating with the hole in the cup;

a second passage having an upper end configured to receive a portion of a flow of liquid from the nozzle and a lower end; and a valve having a first position that directs liquid to flow through the lower end of the second passage and a second position that directs liquid to flow through the upper end of the first passage.

8. The system of claim 7, wherein the second position of the valve at least partially blocks the flow of liquid through the lower end of the second passage.

9. The system of claim 7, wherein the cup is connected to a guide ring configured to be inserted in the fill passage of the storage tank.

10. The system of claim 9, further comprising a sleeve configured to be connected to the guide ring.

11. The system of claim 10, wherein the sleeve has a mounting flange.

12. The system of claim 7, further comprising a float connected to the valve.

13. The system of claim 7, further comprising a venturi connected to the first passage.

14. A system for preventing overflow in a storage tank which is fillable via a nozzle, the system comprising:

a fill passage connecting the storage tank to an external atmosphere;

a cup disposed within the fill passage and having a spring-loaded flap at its lower end;

an adjacent passage having a lower end disposed at a predetermined level within the storage tank and an upper end communicating with a hole in the fill passage;

a vent passage connecting the adjacent passage to the external atmosphere; and a valve disposed in the vent passage which permits the flow of air through the vent passage and prohibits the flow of liquid through the vent passage.

15. The system of claim 14, further comprising a fill fitting disposed at least partially within the fill passage.

16. A system for preventing overflow in a storage tank which is fillable via a nozzle, the system comprising:

a fill passage connecting the storage tank to an external atmosphere;

a cup disposed within the fill passage;

an adjacent passage having a lower end disposed at a predetermined level within the storage tank and an upper end communicating with a hole in the fill passage; wherein, after a level of liquid in the storage tank reaches the predetermined level, a portion of the liquid will rise through the adjacent passage, and out of the hole in the fill passage;

a vent passage connecting the adjacent passage to the external atmosphere; and a valve disposed in the vent passage which permits the flow of air through the vent passage and prohibits the flow of liquid through the vent passage.

17. The system of claim 16, wherein the hole in the fill passage corresponds to a hole in the nozzle.

* * * * *